United States Patent [19]

Aschberger et al.

[11] Patent Number: 4,966,232

[45] Date of Patent: Oct. 30, 1990

[54] APPARATUS FOR COOLING THE CONTENTS OF A VESSSEL

[75] Inventors: Matthias Aschberger; Karlheinz Färber, both of Giengen; Anton Deininger, Bachhagel, all of Fed. Rep. of Germany

[73] Assignees: The Coca-Cola Co., Atlanta, Ga.; Bosch-Siemens Hausgerate GmbH, Munich, Fed. Rep. of Germany

[21] Appl. No.: 768,439

[22] Filed: Aug. 22, 1985

[30] Foreign Application Priority Data

Aug. 22, 1984 [DE] Fed. Rep. of Germany ..... 3430918

[51] Int. Cl.[5] ..... F28F 3/12; B67D 5/62

[52] U.S. Cl. ..... 165/169; 222/129.1; 222/146.6; 62/394; 29/446

[58] Field of Search ..... 222/146.6, 129.1; 62/394; 29/446, 452, 157.3 V; 242/2, 3, 7.21, 7.22; 165/169

[56] References Cited

U.S. PATENT DOCUMENTS

| | | | |
|---|---|---|---|
| 2,335,038 | 11/1943 | Bridges | 29/452 |
| 2,370,780 | 3/1945 | Crom | 29/452 X |
| 2,426,631 | 9/1947 | Mapes | 242/7.22 |
| 2,455,355 | 12/1948 | Combs | 242/3 X |
| 3,469,415 | 9/1969 | Cornelius | 62/394 |
| 4,061,184 | 12/1977 | Radcliffe | 62/394 X |
| 4,182,013 | 1/1980 | Grossman | 29/157.3 V |
| 4,434,539 | 3/1984 | Sanborn et al. | 29/157.3 V |
| 4,739,630 | 4/1988 | Tandeski et al. | 165/169 X |

*Primary Examiner*—Andres Kashnikow
*Assistant Examiner*—Gregory L. Huson
*Attorney, Agent, or Firm*—Birch, Stewart Kolasch & Birch

[57] ABSTRACT

An apparatus for cooling the contents of a vessel in which refrigerant is passed through pipelines placed as a coil alongside the outer wall of the vessel, the pipelines in the areas of the starting end and of the finishing end of the coil are fastened upon the vessel by clamping elements and laid under tensile stress alongside the vessel.

9 Claims, 2 Drawing Sheets

FIG.3
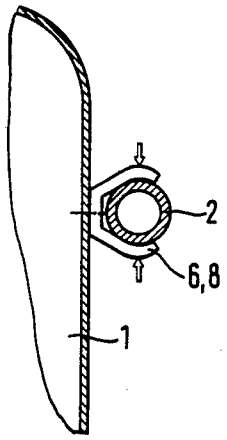
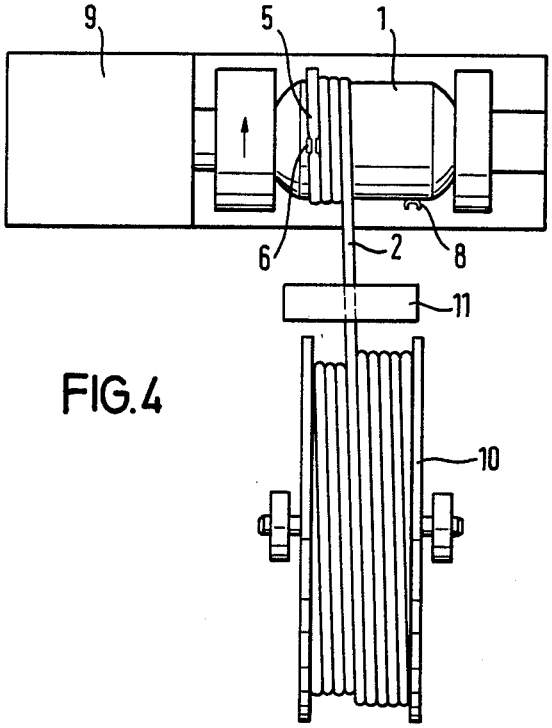
FIG.4

APPARATUS FOR COOLING THE CONTENTS OF A VESSEL

BACKGROUND OF THE INVENTION

The invention relates to an apparatus for cooling the contents of a vessel, more particularly a container for the carbonization of water for a beverage dispenser by means of a refrigerant passed through pipelines placed as a coil alongside the outer wall of the vessel.

For example, in order to enrich water with carbon dioxide for use in a beverage dispenser, it is necessary, or at least very expedient, to cool the water supply. In order to be able to carry out this cooling as intensively as possible and with a high degree of efficiency, it is, for instance, known and described in West German Unexamined Application 28 32 377 to place the pipelines for the refrigerant within the storage vessel and, thereby, directly in the liquid to be cooled. To assist the carbonization process, a pressure vessel is used in which the carbonization process takes place under a high pressure. The arrangement of the pipelines for the refrigerant within this pressure vessel necessitates its introduction from the outside into the vessel, with the bushings being sealed in such a way that they can also withstand the high internal pressure. The problem with these bushings is that the pipelines for the refrigerant are subjected to relatively great temperature variations, due to the normally intermittent cooling operation, which leads to continuous fluctuations in the diameter. In addition, in internal pipelines one must take into consideration the fact that the pipeline material must at all times retain its resistance to the carbonized water.

Therefore, the pipelines for the refrigerant are preferably placed alongside the outer wall of the storage vessel. For example, they may surround the storage vessel in a screw-like manner.

Based on these findings, it is the major object of the invention to provide an apparatus for cooling the contents of a vessel that can be manufactured with relative ease from the production-engineering standpoint, is suitable for the cooling of semi-luxurious foodstuffs, and operates with the highest degree of efficiency. In order to minimize the manufacturing effort and maximize its usability for semi-luxurious foodstuffs, the approach should be taken of placing the pipelines for the storage vessel outside the outer walls thereof.

According to the invention, an apparatus that satisfies the above requirements is characterized by the fact that the pipelines for the refrigerant are fastened upon the vessel in the areas of the starting end and of the finishing end of the coil by means of clamping elements and are laid under tensile strength alongside the vessel wall. More particularly, the pipeline is designed with a flattened cross section and a heat-conducting paste is introduced between pipeline and vessel wall.

Especially because the pipeline in the areas of the starting end and of the finishing end of the coil is fastened upon the vessel by means of clamping elements and is thus laid continuously under tensile stress alongside the outer wall of the vessel, a high thermal or cold conductivity is provided between the pipeline for the refrigerant and the vessel to be cooled, so that the refrigeration unit operates with a relatively high degree of efficiency. This efficiency is improved further by providing the pipeline with a flattened cross section and by introducing a heat-conductive paste between pipeline and vessel wall. Clamp-type brackets are fastened upon the vessel so as to attach the pipelines thereto, by means of which the end portions of the pipelines are clamped by elastic deformation.

To achieve a high thermal conductivity, the vessel proper is to be made of metal, particularly stainless steel, in view of its use for a semi-luxurious foodstuff. Also, in order to attain a high thermal conductivity, the pipeline for the refrigerant is made of a highly thermal conductive material. Normally, these materials also have a high expansion coefficient that can be controlled as a function of the temperature, in relation, for example, to steel or stainless steel. This property is particularly advantageous for the apparatus embodying the invention. Thus, during the cooling phase, the pipeline is in tight engagement with the outer wall of the storage vessel. Since the pipeline for the refrigerant is fastened upon the storage vessel by the finishing ends of its coil, the resulting tensile stress will not result in a slackening of the pipeline stress around the storage vessel. Outside the cooling phases, the stress is reduced again. Therefore, a continuous elastic longitudinal expansion of the pipeline will not occur.

From the production-engineering standpoint as well, the apparatus incorporating the invention can be manufactured with relative ease and at low cost, preferably using a fabrication technique that is characterized by the fact that the pipeline in the area of the starting end of the coil is clamped on the vessel wall, that the pipeline is wound under tensile stress on the circumference of the vessel, with coincident deformation of a round cross section into an oval cross section, after which the pipeline in the area of the finishing end of its coil is again clamped on the vessel. Following the clamping of the starting end of the coil on the vessel wall, the vessel is rotated, causing the pipeline to be wound under tensile stress on the circumference of the vessel. In the process, the pipe with an extra wide standard cross section is deformed into the desired oval cross section and is in tight engagement with the vessel wall. After the finishing end of the coil, the end portion of this pipeline is again clamped on the vessel wall and, after an extended connection piece, the pipeline is cut off.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 3 shows a detail in the area of a mounting location, FIG. 4 is a schematic view of a system for winding a pipeline on the storage vessel.

DETAILED DESCRIPTION OF A PREFERRED EMBODIMENT

Figure 1:
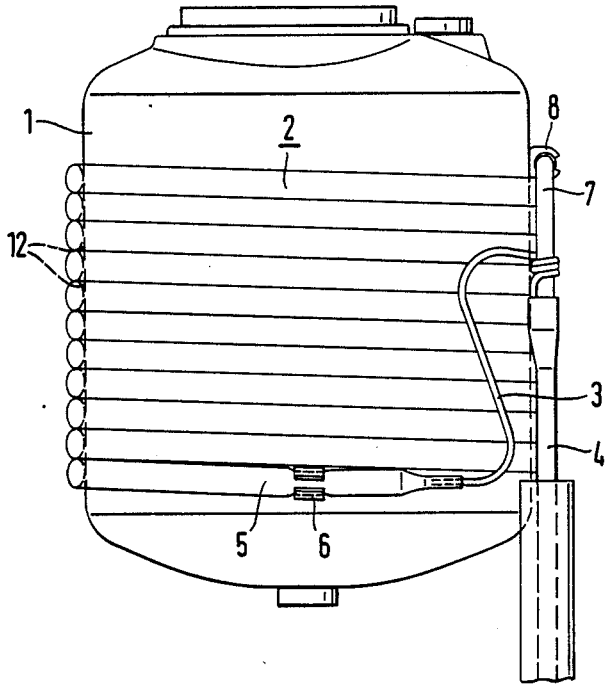
FIG. 1 is a side view of a storage vessel on which a pipeline for the refrigerant is wound of the present invention.
Figure 2:
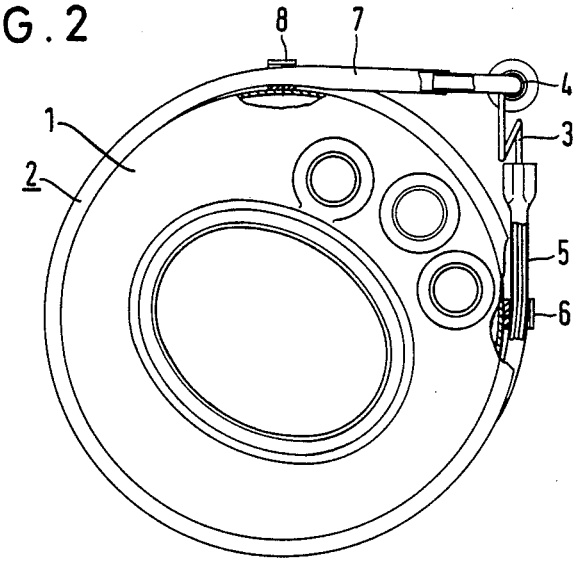
FIG. 2 is a top plan view of this vessel.

FIGS. 1 and 2 depict a storage vessel 1 such as, for example, used in a beverage dispenser for the processing and storing of carbonized water. In order to assist the carbonizing process that uses a mixture of fresh water and $CO_2$ gas to provide for a cold drink, it is necessary, or at least expedient, to cool the storage vessel 1 and, with it, the $CO_2$ water supply. To this end, pipelines 2 that form a part of a cooling system (not shown in detail herein) are placed in screw-like fashion on the circumference of the storage vessel 1. The refrigerant is fed by this cooling system via the supply line designed as a throttling path and is returned via the discharge line 4.

For reasons of thermal conductivity, the storage vessel 1 is made of metal. At least its inner wall must be corrosion-resistant. Advantageously, the storage vessel 1 is made entirely of stainless steel. The pipeline 2 must have a high thermal conductivity coefficient and be made of a suitable metal. The efficiency for the cold transmission from the pipeline 2 to the storage vessel 1 depends essentially on the resistance to heat transmission between these two elements.

This heat transmission is favorably influenced because the pipelines are in the most intimate contact, and over the largest area possible, with the storage vessel. This is achieved because the pipeline 2 is in conforming surface engagement with the storage vessel 1 due to a tensile force acting thereupon accompanied by a material-induced elastic deformation. This tensile force is applied to the pipeline 2 during the process of winding the pipeline 2 in screw-like fashion on the vessel 1 and, by means of clamping elements 6, 8 fastened upon the storage vessel 1. This tensile force is continuously applied to the areas of the starting end 5 and of the finishing end 7 of the pipeline 2. During the clamping, the area of the pipeline 2 seized by the clamping elements 6, 8 is also subject to deformation, so that the pipeline is locked by mechanical forces and through its shape. To increase the bearing face between the pipeline 2 and the storage vessel 1, an oval cross section has been chosen for the pipeline 2. The remaining spaces between the pipeline 2 and the storage vessel 1 are filled with a heat-conductive paste 12 in order to improve the energy flow.

The system shown schematically in FIG. 4 is used to wind the pipeline 2 on the storage vessel 1. To do this, the starting end of the pipeline 2 is fastened upon the storage vessel 1 by means of the clamping elements 6.

By means of a drive 9, the storage vessel 1 is rotated, so that the pipeline 2 is drawn off by a storage drum 10 and wound on the storage vessel 1. The required tensile force is generated by a clamping device 11. As a result of the tensile stress applied to the pipeline 2 and of the winding process, the originally round cross section of the pipeline 2 is deformed into the desired oval cross section. Upon completion of the winding process, the end portion of the pipeline 2 as well is fastened with the clamping element 8 upon the storage vessel 1, followed by a cutting off of the pipeline fed by the storage drum 10.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An apparatus for cooling contents of a vessel comprising:

a vessel;

a pipe having a first and second end coiled about said vessel through which a fluid is circulated for cooling said pipe and the contents of said vessel; and pipe fastening means for substantially securing said first and second ends of said pipe to said vessel from relative movement therebetween, said pipe fastening means maintaining a substantial tension force along the length of said pipe within the elastic limits of the pipe material for holding said pipe in close intimate contact with said vessel for efficient energy transfer between said contents within said vessel and said fluid circulating within said pipe.

2. The apparatus according to claim 1, wherein said first and second ends of said pipe are clamped to said vessel by plastic deformation of said pipe by said pipe fastening means.

3. The apparatus according to claim 1, including heat-conducting paste positioned between said pipe and said vessel.

4. The apparatus according to claim 1, wherein the thermal coefficient of the pipe is greater than that of the vessel.

5. The apparatus according to claim 1, wherein said pipe is formed with a flattened cross section.

6. The apparatus according to claim 5, wherein said first and second ends of said pipe are clamped to said vessel by plastic deformation of said pipe by said pipe fastening means.

7. The apparatus according to claim 6, including heat-conducting paste positioned between said pipe and said vessel.

8. The apparatus according to claim 2, wherein the thermal coefficient of the pipe is greater than that of the vessel.

9. A method of making an apparatus for cooling contents of a vessel, said method including the steps of:

(a) securely clamping one end of a pipe through which a cooling fluid can circulate around the vessel;

(b) winding said pipe around said vessel maintaining a substantial tension along the length of said pipe within the elastic limits of the pipe material and throughout the winding step; and (c) securely clamping the other end of said pipe, while the pipe is still under substantial tension, to said vessel.

* * * * *